US008801360B2

(12) United States Patent
Sheth et al.

(10) Patent No.: US 8,801,360 B2
(45) Date of Patent: Aug. 12, 2014

(54) CENTRIFUGAL PUMP WITH THRUST BALANCE HOLES IN DIFFUSER

(75) Inventors: Ketankumar K. Sheth, Tulsa, OK (US); Brown Lyle Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 1003 days.

(21) Appl. No.: 12/878,850

(22) Filed: Sep. 9, 2010

(65) Prior Publication Data

US 2011/0058928 A1 Mar. 10, 2011

Related U.S. Application Data

(60) Provisional application No. 61/240,901, filed on Sep. 9, 2009.

(51) Int. Cl.
*F04D 1/10* (2006.01)
*F04D 29/44* (2006.01)

(52) U.S. Cl.
USPC ..... 415/1; 415/199.2

(58) Field of Classification Search
USPC ..... 415/1, 110, 112, 199.1–199.3; 416/104, 416/106, 175, 176, 198 R
See application file for complete search history.

(56) References Cited

U.S. PATENT DOCUMENTS

| | | | | |
|---|---|---|---|---|
| 1,105,808 | A * | 8/1914 | MacNeill | 415/106 |
| 1,642,914 | A * | 9/1927 | Whann | 415/199.1 |
| 3,874,812 | A * | 4/1975 | Hanagarth | 415/106 |
| 4,172,690 | A * | 10/1979 | Kuntz | 415/199.2 |
| 4,249,860 | A * | 2/1981 | Erickson | 415/111 |
| 4,483,660 | A * | 11/1984 | Roberts | 416/213 A |
| 4,838,758 | A | 6/1989 | Sheth | |
| 5,779,434 | A | 7/1998 | De Long | |
| 5,845,709 | A | 12/1998 | Mack et al. | |
| 5,951,248 | A | 9/1999 | Hall | |
| 5,957,656 | A | 9/1999 | De Long | |
| 6,190,141 | B1 | 2/2001 | Henry | |
| 6,406,277 | B1 | 6/2002 | Shafer et al. | |
| 6,676,366 | B2 | 1/2004 | Kao | |
| 6,726,449 | B2 | 4/2004 | James et al. | |
| 6,752,560 | B2 | 6/2004 | Wilson et al. | |
| 6,854,517 | B2 | 2/2005 | Gay et al. | |
| 6,893,207 | B2 | 5/2005 | Kao | |
| 7,409,997 | B2 | 8/2008 | Gay et al. | |
| 7,575,413 | B2 | 8/2009 | Semple et al. | |
| 7,708,534 | B2 | 5/2010 | Parmeter et al. | |

OTHER PUBLICATIONS

U.S. Appl. No. 12/534,046, filed Jul. 31, 2009.

* cited by examiner

*Primary Examiner* — Edward Look
*Assistant Examiner* — Sean J Younger
(74) *Attorney, Agent, or Firm* — Bracewell & Giuliani LLP

(57) ABSTRACT

A centrifugal pump has alternating impellers and diffusers. One or more vent holes extend through one or more vanes of one or more diffusers. In an upthrust condition, high pressure production fluid from an upper impeller is able to pass through the one or more vent holes, and thereby exert force on the preceding impeller. The force exerted on the preceding impeller offsets the upthrust force acting against the preceding impeller.

20 Claims, 6 Drawing Sheets

Fig. 3
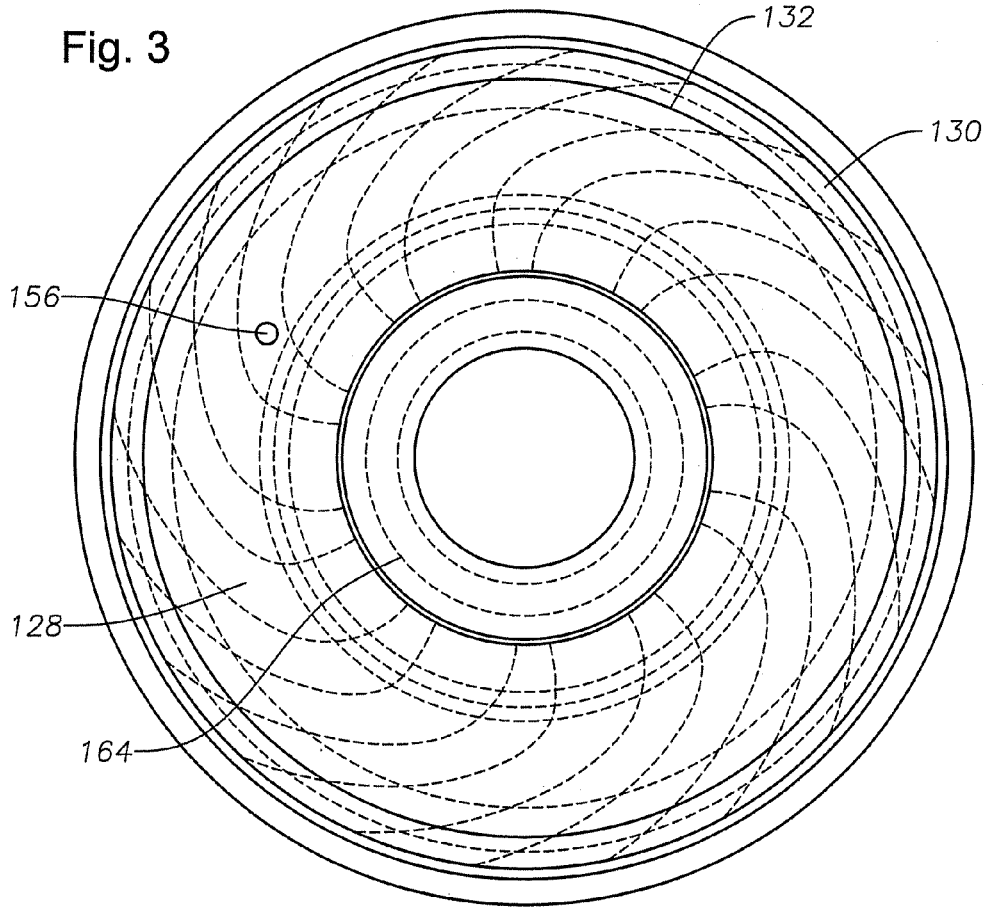
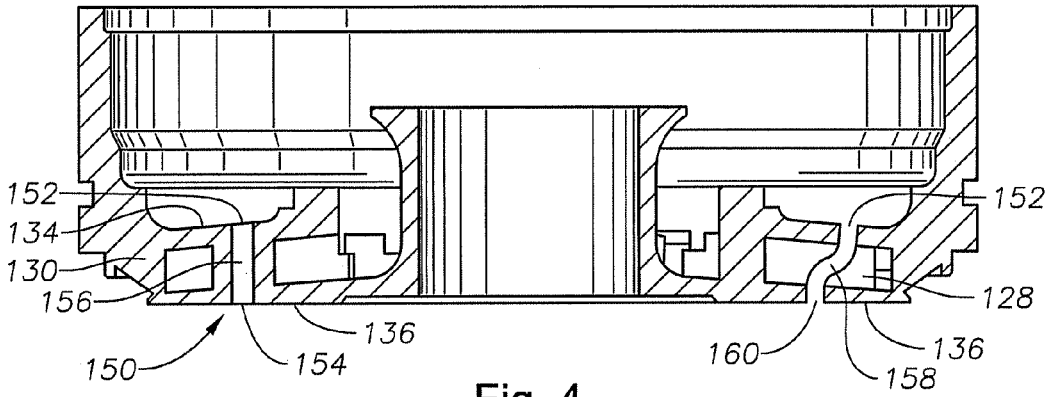
Fig. 4

CENTRIFUGAL PUMP WITH THRUST BALANCE HOLES IN DIFFUSER

CROSS-REFERENCE TO RELATED APPLICATION

This application claims priority to provisional application 61/240,901, filed Sep. 9, 2009, incorporated herein by reference.

BACKGROUND OF THE INVENTION

1. Field of the Invention

The present invention relates to an apparatus and method for manufacturing a centrifugal pump that mitigates the effects of upthrust. More specifically, the invention relates to a submersible centrifugal pump having one or more passages through one or more diffuser vanes to communicate pressure and thus reduce the effects of upthrust force.

2. Description of the Related Art

Centrifugal pumps can include a series of alternating impellers and diffusers. The impellers can rotate together by, for example, being connected to a common shaft. Fluid enters a base of each impeller and travels radially outward through a passage defined by vanes within the impeller. Centrifugal force, from the rotation of the impeller, accelerates the fluid through the impeller passages. The fluid exits the impeller and enters the diffuser.

Each diffuser is stationary relative to the adjacent impeller. The fluid moves through diffuser passages, which are passages defined by vanes within the diffuser. As the fluid moves through the diffuser, the fluid's velocity decreases as its pressure increases. The fluid exits the diffuser to enter into a subsequent impeller.

Upthrust and downthrust forces can act on each impeller during operation. Upthrust forces, being force acting in the direction of fluid flow, can occur from the pressure of the fluid below the impeller. Downthrust forces can occur from the head pressure of the fluid above the impeller. In some operating conditions, upthrust forces can exceed downthrust forces, thereby causing the impeller to move axially in a downstream direction. The operating conditions can be, for example, when little head pressure exists. Head pressure can be low when first starting the pump or at a maximum flow condition. It is desirable to reduce the upthrust forces during times when upthrust force exceeds downthrust force.

SUMMARY OF THE INVENTION

A centrifugal pump is used for pumping fluid. It can be used, for example, to pump fluid from a wellbore. In one embodiment, the pump includes a pump housing and a first and second diffuser located within the pump housing, each diffuser having a plurality of diffuser passages defined by a plurality of vanes. The pump can also include impellers located adjacent to or radially within each diffuser. An upper surface of a diffuser and a lower surface of an adjacent impeller can define an annular recess between the diffuser and impeller. Similarly, a void can be defined by a lower surface of a diffuser and an upper surface of an adjacent impeller. During operation, pressure within the annular recess may increase, contributing to an upthrust condition.

In one embodiment, a vent passage passes through the a diffuser to provide communication between the annular recess and the void. The vent passage can, for example, pass through a vane of the diffuser and, thus, not obstruct flow within the diffuser passage. In an upthrust condition, as pressure increases in the annular recess beneath the impeller, fluid can pass through the vent passage of the preceding diffuser into the void below the diffuser. The passage of fluid can reduce the pressure in the annular recess and, thus, reduce the pressure acting against the bottom side of the first impeller. The passage of fluid can also increase the pressure in the void and, thus, increase the force acting against the top of the preceding impeller. The upthrust force, thus, is reduced or offset for both impellers on either side of the diffuser having the vent passage. In some embodiments, a rotating seal can be located between the lower surface of the diffuser and the upper surface of the impeller to contain fluid within the void.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

FIG. 3 is a top-view of a diffuser of the electrical submersible pump of FIG. 1.

FIG. 4 is a side sectional view of the diffuser of FIG. 3.

DETAILED DESCRIPTION OF THE EXEMPLARY EMBODIMENTS

Figure 1:
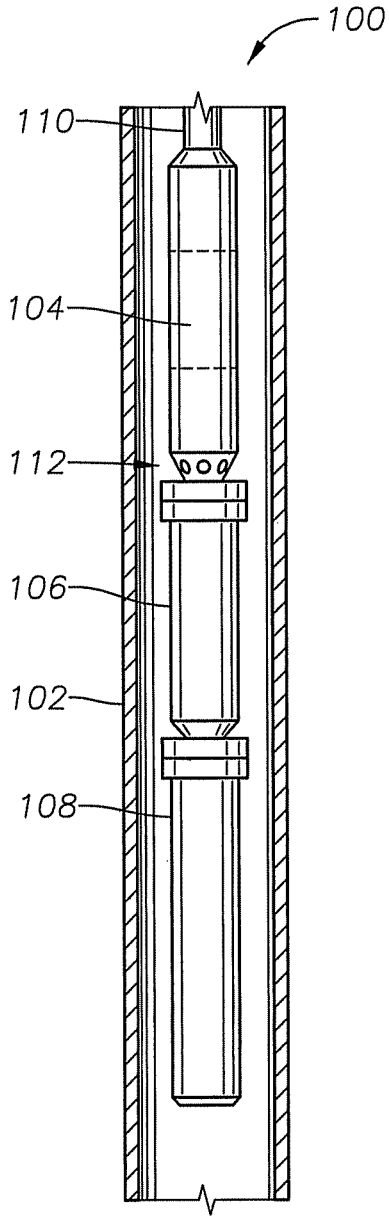
FIG. 1 is a side view of an electrical submersible pump assembly constructed in accordance with the invention and in a wellbore.

Referring to FIG. 1, an example embodiment of an electrical submersible pump ("ESP") 100 is shown located in wellbore 102. Casing may be used wellbore 102. ESP 100 comprises pump assembly 104, seal section 106, and motor 108. ESP 100 may be suspended from tubing 110 in wellbore 102, wherein it is submerged in wellbore fluid. Wellbore fluid is drawn into pump inlet 112 on pump 104 and then pumped up to the surface through tubing 110. The wellbore fluid can be any type of fluid including, for example, product fluid such as oil, natural water-drive fluid, or injected drive fluid.

Figure 2:
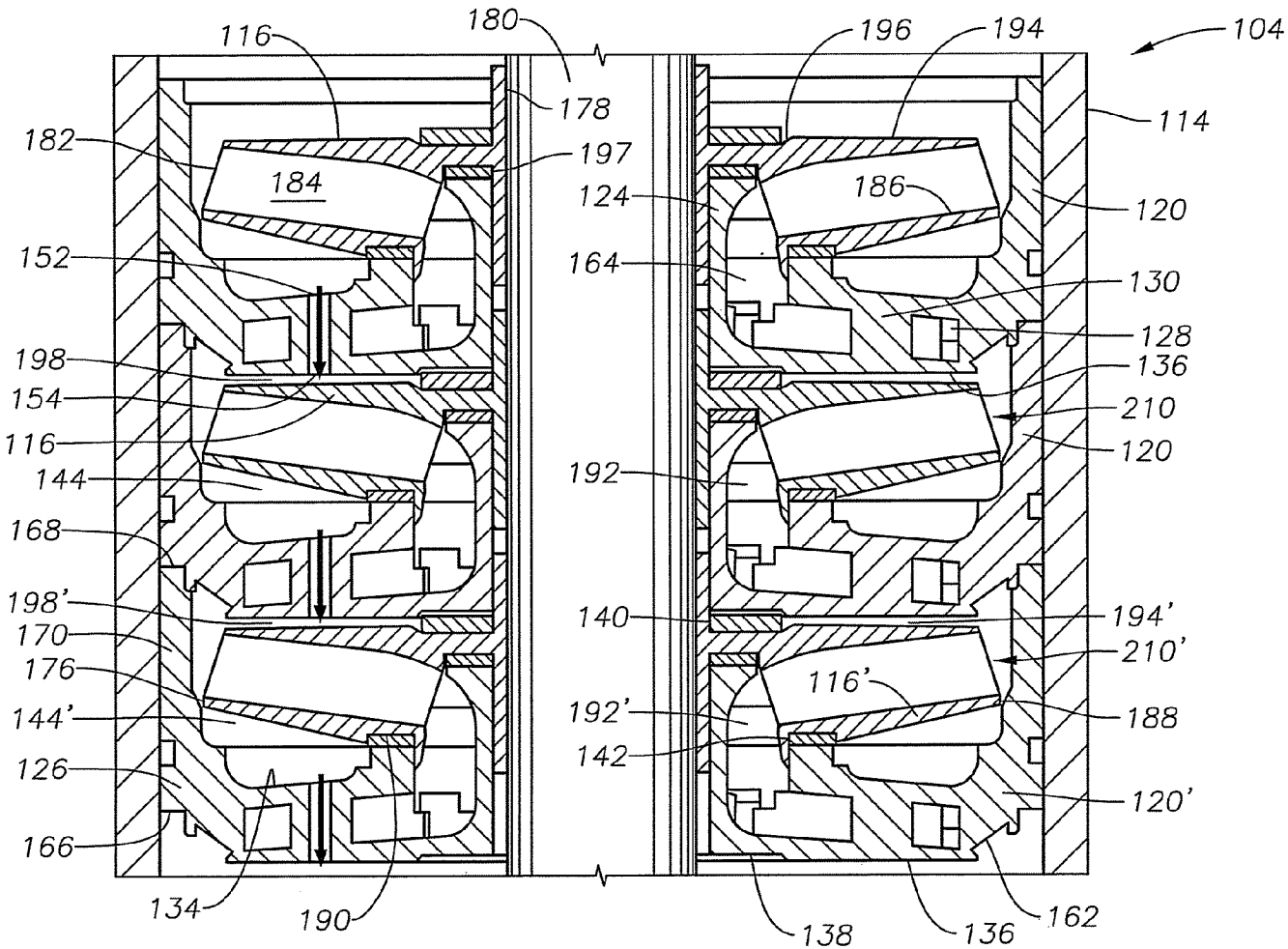
FIG. 2 is a partial sectional view of the electrical submersible pump of FIG. 1.

Motor 108 may be any type of motor including, for example, an electric motor. Seal section 106 has a housing, a seal section shaft (not shown), and means for equalizing pressure (not shown) of the lubricant in motor 108 with the hydrostatic fluid in well 102. Motor 108 has a shaft (not shown) that connects to seal section shaft. Seal section shaft passes through seal section 106 to the base of pump assembly 104. Referring to FIG. 2, an exemplary embodiment of the pump assembly 104 of FIG. 1 is shown with an outer pump housing 114, impellers 116, and diffusers 120 located within pump housing 114.

Referring to FIG. 2, pump housing 114 is a tubular member that forms an exterior of pump assembly 104. Housing 114 may be made of metal, plastic, or any other suitably rigid material. Pump housing 114 can contain and protect components of pump assembly 104.

For the sake of clarity in describing an embodiment of a centrifugal pump with upthrust balancing holes, some references refer to "upper" and "lower," as though ESP 100 is in a substantially vertical position. These positional references are for description only, and should not be construed to limit the invention to an application wherein electrical submersible pump 100 is in a vertical orientation. Indeed, ESP 100 may be in a horizontal orientation or any other orientation.

Diffusers 120 can be stationarily located within pump housing 114. One or more diffusers 120 may have a different design than one or more other diffusers 120 or they may have a substantially similar design. Diffusers 120 may be of volute, radial, mixed flow, or axial designs. Each diffuser 120 has a generally curved outer surface and an outer diameter sized to fit within the inner diameter of pump housing 114. Diffuser 120 has central bore 124 defined by its inner diameter. The outer diameter of diffuser 120 is defined by diffuser sidewall 126. Each diffuser 120 contains a plurality of passages 128 that extend through diffuser 120. In one embodiment (not shown), wherein a pump housing 114 is not used, a stack of diffusers 120 can be connected by, for example, bolts to create a pump body. In this embodiment, diffuser sidewall 126 can be the exterior surface of pump assembly 104.

Referring to FIG. 3, each passage 128 is defined by vanes 130 that extend helically outward. Diffuser 120 may be a radial flow type, as shown, with passages extending outward in a radial plane or a mixed flow type (not shown), with passages extending axially and radially. Passages 128 generally flow from an outer radial location 132 near the lower portion, or base, of diffuser 120 and then move inward, nearer the center of the diffuser 120, as the passage 128 moves along the axial length of diffuser 120. In some embodiments, the cross-sectional area of passages 128 also tends to increase as the passage 128 moves from the base of diffuser 120 toward the top of diffuser 120. Thus fluid entering passage 128 near the periphery of diffuser 120 at high velocity is slowed to a lower velocity, but higher pressure, as the fluid moves radially, or both axially and radially, through passage 128. Vanes 130 form the sidewalls of passages 128.

Referring back to FIG. 2, upper shroud 134 defines the top of the passage 128. Diffuser lower shroud 136 defines the bottom of the passage 128. The bottom surface of diffuser lower shroud 136 may have annular groove 138 for engaging upthrust washer 140, which could be, for example, a thrust bearing washer. Upper shroud 134 of diffuser may have eye washer 142 for engaging impeller 116. The profile of upper shroud 134 may create an annular recess 144 relative to diffuser sidewall 126 and eye washer 142. Annular recess 144 is a void space that may fill with fluid during operation.

Referring to FIG. 4, vent hole 150 is shown formed through diffuser lower shroud 136. In some embodiments, vent hole 150 is a passage through diffuser vane 130. In these embodiments, vent hole 150 has top opening 152 through upper shroud 134 and bottom opening 154 through diffuser lower shroud 136, each connected by passage 156. In some embodiments, vent hole 150 includes a tube 158. In these embodiments, top opening 152 is in communication with tube 158. Tube 158 passes through a portion of diffuser lower shroud 136, or is in communication with passage 160 that passes through diffuser lower shroud 136. Tube 158 may occupy a portion of passage 128.

Each opening 152, 154 may be round, square, elliptical, or any other shape. Furthermore, top opening 152 and bottom opening 154 need not have the same shape. The cross-section of passage 156, tube 158, and passage 160 may be round, elliptical, or any other shape. The overall dimensions of vent hole 150 may be any size. In embodiments wherein vent hole 150 is a passage through vane 130, the size of vent hole 150 may be limited by the dimensions of vane 130 through which vent hole 150 passes. Embodiments using tube 158 are not so limited, as the outer diameter of tube 158 may be wider than the width of passage 128.

Any number of vent holes 150 may be used. Some embodiments may have just one vent hole 150 through each diffuser 120. Other embodiments may have multiple vent holes 150 equally spaced around diffuser 120 or unequally spaced around diffuser 120. Indeed, some embodiments may have one or more vent holes 150 through each vane 130. The vent holes 150 may be spaced at any distance between bore 124 and outer radial location 132. In some embodiments, the radial location of vent hole 150 may be different than the radial location of an adjacent vent hole 150. The number, size, and location of vents holes 150 may be calculated to allow a predetermined amount of fluid to pass through diffuser lower shroud 136 at a given pressure.

Referring back to FIG. 2, passages 128 may open to diffuser inlet 162, located near diffuser lower shroud 136, for receiving fluid from impeller 116. In the example of FIG. 2, diffuser passages 128 terminate at diffuser exit 164. Diffuser exit 164 may be an annular groove defined by the upper, inner diameter portions of diffuser vanes 130.

Diffuser lower shroud 136 of diffuser sidewall 126 may have downward facing lower interlocking member 166, such as a shoulder or rabbet, for receiving a corresponding upper interlocking member 168 on the upper end of an adjacent diffuser 120.

Upper sidewall 170 of diffuser 120 is a cylindrical member having an inner diameter greater than the largest outer diameter of impeller 116. The inner diameter of upper sidewall 170 narrows at the impeller interface point 176. The inner diameter of impeller interface point 176 is roughly the same as, or slightly larger than, the outer diameter of impeller 116.

Referring still to FIG. 2, impeller 116 is a rotating pump member that uses centrifugal force to accelerate fluids. Impeller 116 has a central bore defined by the inner diameter of impeller hub 178. Shaft 180 passes through central bore of impellers 116. Impellers 116 may engage shaft 180 by any means including, for example, splines (not shown) or keyways (not shown) that cause impellers 116 to rotate with shaft. One end of shaft 180 may engage shaft (not shown) of seal section 106 (FIG. 1) or otherwise be coupled to shaft (not shown) of motor 108. In some embodiments, two or more pump assemblies 104 may be used and thus shaft 180 may be coupled to a shaft (not shown) of an adjacent pump assembly (not shown).

Impeller vanes 182 may be attached to or integrally formed with impeller hub 178. Vanes 182 may extend radially from impeller hub 178 and may be normal to shaft 180, or may extend at an angle. In some embodiments, vanes 182 are curved as they extend from impeller hub 178. Passages 184 are formed between surfaces of vanes 182.

Lower shroud 186 forms an outer edge of impeller 116 and may be attached to or join an edge of vanes 182. In some embodiments, lower shroud 186 is attached to impeller hub 178, either directly or via vanes 182. In some embodiments, impeller hub 178, vanes 182, and lower shroud 186 are all cast or manufactured as a single piece of material.

Impeller edge 188 is a surface on an outer diameter portion of impeller 116. In an exemplary embodiment, outer edge 188 is the outermost portion of lower shroud 186. Outer edge 188 need not be the outermost portion of impeller 116. The diameter of edge 188 is slightly smaller than the inner diameter of impeller interface point 176.

Lower shroud 186 may have lower lip 190 for engaging impeller eye washer 142 on diffuser 120. Lower lip 190 may be formed on the bottom surface of lower shroud 186. Lower shroud 186 defines impeller inlet 192 from below impeller 116 into the passages 184 formed between vanes 182.

Impeller upper shroud 194 is located at the opposite end of vanes 182 from lower shroud 186. Impeller upper shroud 194 may be attached to or join vanes 182. Impeller upper shroud 194 generally defines an upper boundary of passages 184 between vanes 182. Upper shroud 194 may have sealing surface 196 for sealing against upthrust washer 140 of diffuser 120. Downthrust washer 197 may be located between a downward facing surface of impeller 116 and an upward facing surface of diffuser 120.

Figure 5:
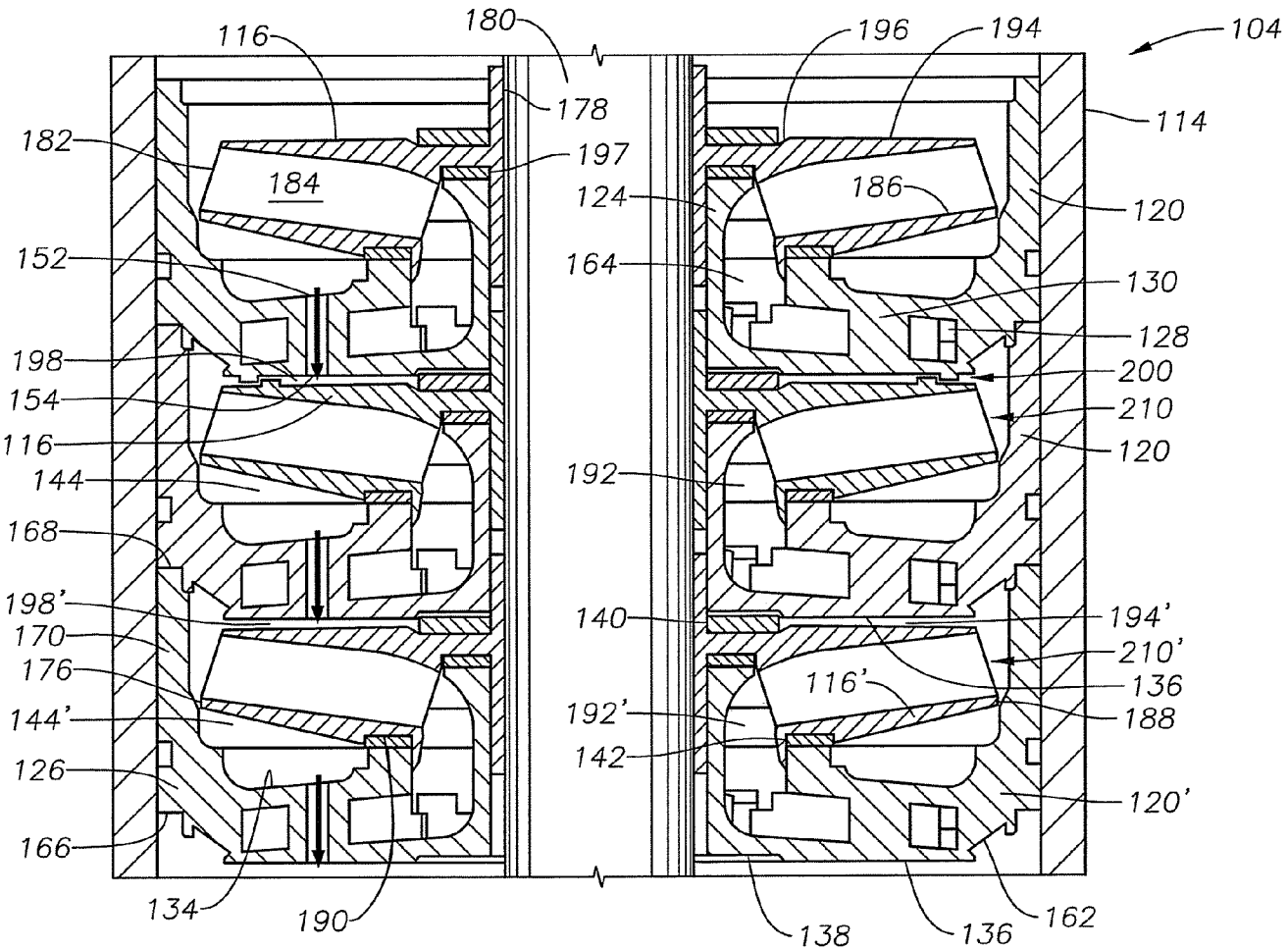
FIG. 5 is an alternative embodiment of the electrical submersible pump of FIG. 1.
Figure 6:
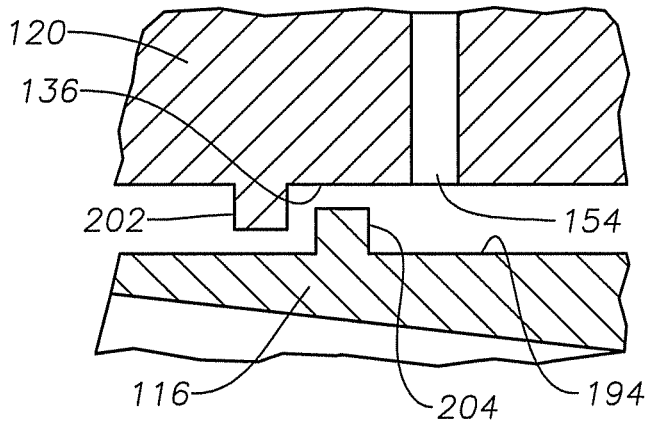
FIG. 6 is a side sectional detail view of a running seal of the alternative embodiment of the electrical submersible pump of FIG. 5.
Figure 7:
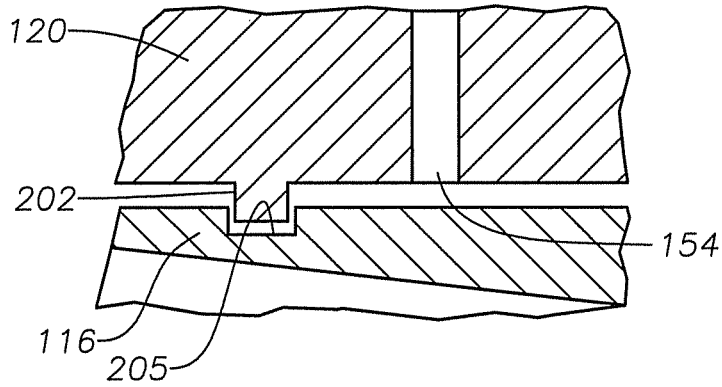
FIG. 7 is another alternative embodiment of the electrical submersible pump of FIG. 5.

Void 198 is a space bounded on the bottom by impeller upper shroud 194 and on the top by diffuser lower shroud 136. Upthrust washer 142 or a portion of impeller hub 178 may form a boundary on one side of void 198. Referring to FIG. 5, in some embodiments, rotating seal 200 may form a boundary on one side of void 198. Rotating seal 200 is a seal for retaining fluid and pressure in void 198. Shroud stationary seal lip 202 (FIG. 6) may be attached to or formed with the lower surface of diffuser lower shroud 136. Similarly, impeller rotating seal lip 204 (FIG. 6) may be a seal formed with or attached to impeller upper shroud 194. In some embodiments, rotating seal groove 205 is located on diffuser lower shroud 136 (as shown in FIG. 7) or on impeller upper shroud 194 (not shown). In these embodiments, rotating seal lip 202 or 204 fits into rotating seal groove 205 to retain pressure in void 198. Other configurations of rotating seal 200 may be used. In some embodiments, rotating seal 200 is not used with void 198.

Within a single pump housing, one or more of the plurality of impellers 116 may have a different design than one or more of the other impellers, such as, for example, impeller vanes having a different pitch.

A plurality of impellers 116 may be installed on shaft 180. A plurality of diffusers 120 are installed, alternatingly, between impellers 116. The assembly having shaft 180, impellers 116, and diffusers 120 is installed in pump housing 114.

Figure 8:
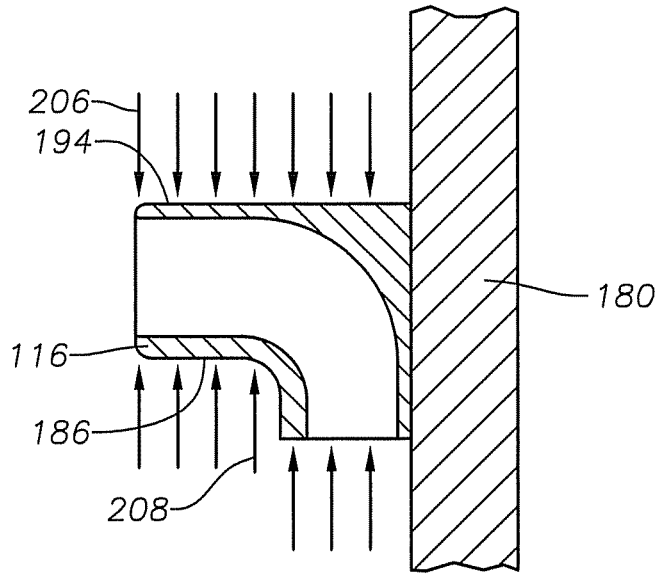
FIG. 8 is a partial sectional view of an impeller of the submersible pump assembly of FIG. 1.

Referring to FIG. 8, two axial forces typically act on impeller 116 during operation—downthrust force 206 and upthrust force 208. Downthrust force 206 is defined as a force on the impellers 116 acting against the direction of flow, thus urging impellers 116 in an upstream direction (away from discharge tubing 110 (FIG. 1)). Upthrust force 208 is defined as force acting on the impellers 116 in the same direction as the direction of flow, thus urging impellers in a downstream direction (towards discharge tubing 110 (FIG. 1)). Upthrust forces 208 occur, for example, when the discharge fluid from the first impeller 116' (FIG. 2) exerts force against the downstream impeller 116. Low head pressure, such as during a high flow rate, may cause significant upthrust forces on impeller 116.

Downthrust forces 206 occur, for example, when head pressure exerts force on impellers 116, thus urging impellers 116 in a direction opposite the direction of flow (i.e., away from tubing 110). Higher head pressure, such as in a no-flow condition, may exert the greatest amount of downthrust force 206 on impellers.

Figure 9:
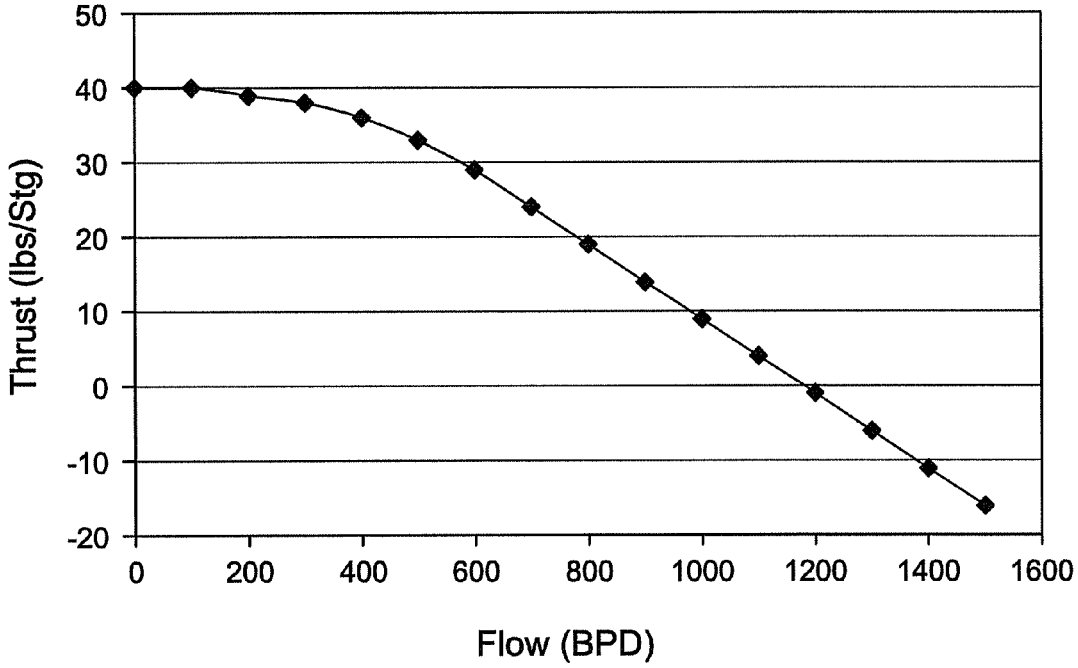
FIG. 9 is a graph of flow versus thrust for a pump constructed in accordance with this disclosure.

Thrust characteristics vary depending on stage design. In an exemplary embodiment, thrust characteristics acting on impeller 116 may vary from downthrust of approximately 40 pounds per stage when flow is zero to upthrust of approximately 15 pounds per stage when flow approaches approximately 1500 barrels per day. An example of thrust characteristics is shown in FIG. 9. Other impeller and pump designs may have different thrust and flow characteristics.

Under normal operating conditions, downthrust force 206 exceeds upthrust force 208, thus urging impellers in an upstream direction (i.e. towards motor 108), relative to flow ("downthrust condition"). In some circumstances, upthrust force 208 may exceed downthrust force 206. This "upthrust condition" may occur during startup, before the pump develops head pressure, or during a maximum flow condition when there is little or no head pressure.

Referring back to FIG. 2, in operation, fluid enters impeller at impeller inlet 192. Shaft 180 rotates, causing impellers 116 to rotate, while diffusers 120 remain stationary relative to pump housing 114. Wellbore fluid entering pump inlet 112 (FIG. 1) is drawn through impeller inlet 192 and into passage 184 of impeller 116. The rotation of impeller 116 accelerates fluid out of passage 184 into diffuser passage 128. In diffuser passage 128, the fluid velocity is decreased and pressure is increased. The fluid exits diffuser passage 128, passing through the opening defined by lower shroud 186 as it enters the next impeller 116. The wellbore fluid continues to pass through each subsequent diffuser 120 and impeller 116 until it reaches tubing 110, wherein it is propelled up through tubing 110.

Fluid may rotate in a plurality of locations within pump housing 114. In recess 144, for example, fluid may rotate below lower shroud 186. The fluid, being located between rotating impeller 116 and stationary diffuser 120, may rotate at approximately one half the rotational velocity of impeller 116. Similarly, fluid in void 198 may rotate between impeller upper shroud 194 and diffuser lower shroud 136. Like the fluid in annular recess 144, fluid in void 198 may rotate at approximately one half the rotational velocity of impeller 116.

In an exemplary multistage pump, each stage (impeller 116 and diffuser 120) increases the pressure of the fluid as the fluid moves through the stage. By way of example, assume each stage increases the fluid pressure by 10 psi. If pressure at impeller inlet 192' is 50 psi, then pressure at the next impeller inlet 192 may be 60 psi. Fluid pressure at impeller exit 210' may be approximately 58 psi. Fluid pressure at annular recess 144' and void 198', being near to, and in communication with, impeller exit 210' may also be approximately 58 psi or slightly different than 58 psi.

In this example, pressure in the next state increases by approximately 10 psi, thus causing pressure at impeller exit 210 to be approximately 68 psi. Fluid in annular recess 144 and void 198 will also have a pressure of approximately 68 psi.

One or more vent holes 152 function to communicate pressure from annular recess 144 to void 198'. The communication of fluid, and pressure, reduces the pressure in recess 144. The reduction of pressure in recess 144 reduces the upthrust effect on impeller 116. Furthermore, the increased of pressure in void 198' acts against impeller upper shroud 194' of impeller 116', thus increasing the downthrust force acting on impeller 116'.

Due to the taper profile of diffuser sidewall 126, wherein the inner diameter of diffuser sidewall 126 becomes smaller at impeller interface point 176, downthrust conditions may decrease the clearance between edge 188 of impeller 116 and inner diameter of diffuser 120. During upthrust, however, impeller 116 is urged up and away from diffuser 116, thus causing a larger gap between impeller 116 and diffuser 120 at impeller interface point 176. The gap may allow a greater portion of discharge from impeller 116 to pass into annular recess 144 between impeller 116 and the diffuser 120 below impeller 116. The additional fluid in recess 144 may further contribute to the upthrust condition.

High pressure fluid in annular recess 144 may pass through vent hole 150 and exit below diffuser 120. Pressure in annular recess 144 is generally higher than fluid pressure at the discharge of preceding impeller 116' because the fluid in annular recess 144 has been accelerated by impeller 116. Thus fluid is able to pass from the area of higher pressure, within annular recess 144, to the area of lower pressure (void 198'), below the diffuser 120. The movement of fluid results in less pressure acting against the under side of impeller 116. Furthermore, as fluid passes through vent hole 150 into void 198', the higher pressure urges impeller 116' downward. A larger upthrust condition results in a greater amount of fluid passing into annular recess 144, and thus a greater amount fluid and pressure are available to act against preceding impeller 116'. Thus pressure and flow through vent hole 150 acts to offset upthrust forces acting on impeller 116'.

As each impeller 116 is urged downward, the gap between the impeller 116 and the diffuser 120 is decreased, thereby reducing the flow, and pressure, from impeller 116 to annular recess 144. Thus, when the upthrust condition ceases to exist, the flow and pressure through vent hole 150 is at a minimum and therefore the force acting on impeller 116', which is no longer necessary, is greatly reduced or eliminated.

While the invention has been shown or described in only some of its forms, it should be apparent to those skilled in the art that it is not so limited, but is susceptible to various changes without departing from the scope of the invention.

What is claimed is:

1. An electrical submersible pump assembly, comprising:
- a centrifugal pump having a longitudinal axis;
- a motor operatively coupled to the pump for driving the pump;
- the pump having a plurality of stages, each of the stages comprising an impeller and a diffuser:
- the impeller having a central intake centered on the axis;
- the diffuser having a lower surface, an upper surface, and a plurality of diffuser passages between the lower and upper surfaces and extending toward the axis from a diffuser inlet to a diffuser outlet centered on the axis and registered with the intake of the impeller; and
- a vent passage extending through the diffuser from the lower surface to the upper surface, the vent passage being spaced radially outward from the diffuser outlet and below the impeller.

2. The pump assembly according to claim 1, further comprising an annular recess defined by the upper surface of the diffuser and a lower surface of the impeller, the annular recess being radially outward from the diffuser outlet, and wherein the vent passage extends to the annular recess.

3. The pump assembly according to claim 1, wherein the vent passage is isolated from the diffuser passages.

4. The pump assembly according to claim 1, further comprising an annular cylindrical surface on the lower surface of the diffuser that registers with a cylindrical surface on an upper surface of a next lower impeller, and wherein the vent passage is spaced radially inward from the cylindrical surface of the diffuser.

5. The pump assembly according to claim 1, wherein the inlet of the impeller comprises an annular skirt extending downward from the impeller into the outlet of the diffuser, and wherein the vent is located radially outward from the skirt.

6. The pump assembly according to claim 1, wherein the diffuser passages are defined by diffuser vanes extending between the upper and lower surfaces of the diffuser, and wherein the vent passage comprises an orifice extending through one of the diffuser vanes.

7. The pump assembly according to claim 1, wherein the vent passage comprises a tube passing through at least one of the diffuser passages, the vent passage being sealed from said at least one of the diffuser passages.

8. The pump assembly according to claim 1, wherein the vent passage has an axis spaced radially outward from the axis of the pump.

9. The pump assembly according to claim 1, further comprising an annular downthrust surface on the diffuser in engagement with a downward facing annular downthrust surface on the impeller, and wherein the vent passage is radially outward from the downthrust surfaces of the diffuser and in impeller.

10. A method for pumping fluid from a wellbore comprising:
- providing a submersible pump in the wellbore comprising:
  - a pump housing having a longitudinal axis;
  - a plurality of stages within the pump housing; each of the stages comprising:
  - a diffuser and an impeller, the diffuser having a concentric outlet registering with an inlet of the impeller; and
  - a vent passage extending axially through the diffuser from an upper surface to a lower surface of the diffuser, the vent passage being spaced radially outward from the outlet of the diffuser; the method comprising:
- rotating the impeller of each of the stages to force wellbore fluid through diffuser passages of the diffuser of each of the stages; and
- communicating wellbore fluid pressure through the vent passage from the upper surface to a void at the lower surface of the diffuser.

11. The method according to claim 10, further comprising creating an annular recess between a lower surface of the impeller and the upper surface of the diffuser; and
- flowing a portion of the fluid from the annular recess through the vent passage to the void, wherein the pressure in the annular recess is greater than the pressure in the void, and wherein flowing a portion of the fluid through the vent passage decreases the pressure in the annular recess.

12. The method according to claim 11, wherein decreasing the pressure in the recess reduces an upthrust force on the lower surface of the impeller.

13. The method according to claim 11, the method further comprising providing an annular seal between the lower surface of the diffuser and an upper surface of the impeller of a next lower stage, the annular seal being radially outward from the vent passage, thereby retaining fluid within the void.

14. The method according to claim 11, wherein communicating wellbore fluid pressure through the vent passage increases the pressure in the void.

15. The method according to claim 14, wherein increasing the pressure in the void increases a downthrust force on the impeller of the next lower stage.

16. The method according to claim 11, wherein rotating the impeller of each of the stages causes the impeller to move axially from a first position to a second position, the second position allowing more fluid to enter the annular recess through a gap defined by the impeller and the diffuser than the first position.

17. The method according to claim 16, wherein communicating pressure through the vent passage reduces a pressure differential between the annular recess and the void at a greater rate in the second position than in the first position.

18. An electrical submersible pump system for pumping fluid from a wellbore, the system comprising:

a pump comprising:

a pump housing having a longitudinal axis;

first and second impellers coaxially stacked within the pump housing;

a diffuser coaxially between the impellers, the diffuser having an outlet encircled by a diffuser downthrust surface, the first impeller having an inlet encircled by an impeller downthrust surface that rotatably engages the diffuser downthrust surface;

a vent passage extending through the diffuser from a lower surface to an upper surface of the diffuser radially outward from the impeller and diffuser downthrust surfaces; wherein the system further comprises:

a seal section connected to the pump;

a motor connected to the seal section; and a shaft operably connected to the motor and the pump, the shaft passing through the seal section and operable to transfer torque from the motor to the impellers.

19. The system according to claim 18, further comprising an annular recess defined by the upper surface of the diffuser and a lower surface of the first impeller and a void defined by the lower surface of the diffuser and an upper surface of the second impeller, wherein the vent passage provides communication between the annular recess and the void.

20. The system according to claim 18, further comprising:

an annular diffuser cylindrical surface on the lower surface of the diffuser;

an annular impeller cylindrical surface on an upper surface of the second impeller in rotating engagement with the diffuser cylindrical surface; and wherein the impeller and diffuser cylindrical surfaces are located radially outward from the vent passage.

* * * * *